United States Patent [19]

Carlsson et al.

[11] 4,349,161

[45] Sep. 14, 1982

[54] THREAD DELIVERY DEVICE WITH IMPROVED THREAD-STORAGE DRUM, PARTICULARLY FOR STICKY YARNS

[75] Inventors: Eric Carlsson; Lars Wide, both of Ulricehamn, Sweden

[73] Assignee: Aktiebolaget IRO, Ulricehamn, Sweden

[21] Appl. No.: 79,615

[22] Filed: Sep. 27, 1979

[30] Foreign Application Priority Data

Sep. 27, 1978 [DE] Fed. Rep. of Germany ..... 2842115

[51] Int. Cl.[3] ..... B65H 51/22

[52] U.S. Cl. ..... 242/47.01; 242/47.09; 242/47.12

[58] Field of Search ..... 242/47.01, 47.04, 47.05, 242/47.08, 47.09, 47.12, 47.13; 66/132 R; 139/452

[56] References Cited

U.S. PATENT DOCUMENTS

| | | | |
|---|---|---|---|
| 2,658,254 | 11/1953 | Givens et al. | 242/47.12 |
| 2,889,034 | 6/1959 | Hawtin et al. | 242/47.12 |
| 3,637,149 | 1/1972 | Frei | 242/47.12 X |
| 3,820,731 | 6/1974 | Rosen | 242/47.01 X |
| 3,827,645 | 8/1974 | Rosen | 242/47.12 |
| 3,904,141 | 9/1975 | Rosen | 242/47.12 |
| 3,921,925 | 11/1975 | Sarfati et al. | 242/47.12 |
| 3,940,079 | 2/1976 | Vella | 242/47.12 |
| 3,993,258 | 11/1976 | Jacobsson | 242/47.12 |
| 4,039,155 | 8/1977 | Jacobsson | 242/47.01 X |
| 4,047,675 | 9/1977 | Jacobsson | 242/47.01 |

FOREIGN PATENT DOCUMENTS

| | | |
|---|---|---|
| 1102961 | 3/1961 | Fed. Rep. of Germany . |
| 345293 | 5/1972 | Sweden . |

*Primary Examiner*—Stanley N. Gilreath

*Attorney, Agent, or Firm*—Blanchard, Flynn, Thiel, Boutell & Tanis

[57] ABSTRACT

A thread-storage and delivery device, which includes a storage drum on which a thread is wound to form a thread storage and from which the thread is withdrawn for supply to a textile machine. The drum is formed from a plurality of elongated rods disposed in a cylindrical pattern about the drum axis. The rods define an outer peripheral surface on which the thread windings are engaged. A thread-advancing device has portions thereof projecting radially outwardly between the rods for engaging the thread windings to slide them axially along the peripheral surface. Each rod is provided with a plurality of parallel narrow grooves extending axially thereof, which grooves are separated by narrow axially extending ribs. The outer free edge of each rib defines a narrow axially elongated surface section which defines a part of the peripheral drum surface and is engaged by the thread windings.

2 Claims, 3 Drawing Figures

THREAD DELIVERY DEVICE WITH IMPROVED THREAD-STORAGE DRUM, PARTICULARLY FOR STICKY YARNS

FIELD OF THE INVENTION

The invention relates to an improved thread-storage and delivery device which is particularly suited for handling so-called "sticky-yarns".

BACKGROUND OF THE INVENTION

It was common up to now to make in thread-delivery devices the surface of the storage drum, which surface comes into contact with the thread windings, as smooth as possible, so that both the movement of the thread windings in the longitudinal direction of the drum and also the unwinding of the thread could take place under the least frictional influences. Thus for example the rods of rod drums, which rods are arranged approximately in the longitudinal direction around the drum axis, are made of steel, are ground and polished, or even chromium plated in order to achieve an as small as possible friction of the thread windings lying thereon. In the case of the usual threads this did lead to the desired result. However, in the case of so-called "sticky-yarns", namely in the case of threads which contain synthetic-fiber components or are synthetic and particularly are thin and elastic, and those threads which are waxed, oiled or impregnated, difficulties result during the movement of the thread windings which form the thread storage on the drum jacket, since these adhere and considerably resist the movement. During unwinding of the thread from the thread storage, same also adheres on the drum periphery, so that variations in the thread-withdrawing tension occur. These undesired effects can be found particularly with those adhering threads in a thread-storage and delivery device, as it is known from U.S. Pat. No. 3,904,141. This creates difficulties in evenly moving the thread windings forward. Furthermore those devices which are equipped with a storage drum which has longitudinal slots and webs operate with a feeler and spreading cone, which under a spring load opposite to the forward movement, rests on the front-most windings of the thread storage, measures the thread storage in this manner, and at the same time spreads open at least the front-most winding. During removal of the thread from the drum jacket, same adheres to the support surfaces of the webs, which results in a varying thread-withdrawing tension with tension peaks. The even advance of the thread windings and the constant and low withdrawing tension are, however, also conditions for a breakdown-free operation and qualitatively high-value woven or knitted products, in particular when using "sticky-yarns".

German AS No. 1 102 961 discloses a device for the delivery of thread to a circular knitting machine, in which a constantly rotated, cylindrical delivery drum has several individual side-by-side threads almost totally wound around it. When the knitting machine needs thread, it pulls on the thread, so that same more tightly loops around the drum jacket and, due to the then increasing friction, the thread is progressively delivered to the drum jacket. If the demand drops, the thread becomes loose, and the drum rotates within the thread loop. The drum is here coated with a silicon rubber, which has a smooth surface with a certain friction value with respect to the thread. In order to be able to deliver the threads which lie side-by-side in the longitudinal direction of the drum with speeds which are different from one another, it is furthermore suggested to provide side-by-side lying ring zones on the drum which have surface characteristics and sliding resistances which are different from one another. The ring zone with the largest friction factor results, at a constant thread-looping force and drum speed, in the largest thread-delivery output. All these measures are, however, not advantageous for storage devices of the type mentioned in the beginning, since also in the case of the lastmentioned delivery drum the thread windings, in particular of sticky-yarns, due to the existing adhesion tendency, grip on smooth surfaces relatively independently of the sliding resistance but in dependency on the size of the contact surface.

The basic purpose of the invention is to improve a device of the abovementioned type so that also in the case of "sticky-yarns" the thread advance takes place easily and evenly and the thread-withdrawing tension remains low and even. This purpose is attained inventively by the provision, on the drum, of roughened or interrupted contact surfaces for the thread windings. Surprisingly such a roughened or interrupted contact surface for the thread windings of a "sticky-yarn" shows that the advancing movement now faces a substantially lower resistance and that the thread-withdrawing tension variations are totally eliminated. Even though one actually expected that those thread types which are difficult to handle would be still more difficult to move on a rough contact surface and would even get hooked during the withdrawal, exactly the opposite effect is observed. The achieved advantages can probably be explained by the "sticky-yarns" having a tendency for adhesion which is caused by the material or by impregnation or composition. This effect is similar to the adhesive effect which occurs during the relative movement or separation of two, possibly slimy, glass plates and which is caused by the air pressure or a pressure difference, or the adhesion of a smooth sheet of paper on a sweaty hand, Also the electrostatic charge of the thread can here contribute to the increase in the tendency to adhere. If now the thread finds a connected, larger and smooth contact surface on the drum jacket, a plurality of adhesive force components is formed, which sum up to a resulting force up to the moment of movement or releasing, which force makes movement in the longitudinal direction of the drum and also the withdrawal of the thread more difficult. The plurality of interruptions or recesses according to this invention causes the thread windings to contact only the raised, substantially reduced surface sections, on which an adhesion can hardly occur. Since the surface sections, however, amount only to a fraction of the actually existing drum surface, the entire adhesive force becomes substantially lower than is the case with a continuous and smooth surface. The thread windings do not find a connected contact surface, but so to speak many small surface units. Instead of an adhesion which occurs along one line only, dotlike adhesive areas with very small adhesive forces exist. These then do not sum up in one point, but are overcome at the various points of creation. Since in the peripheral direction of the storage drum a relative movement between the thread windings and the drum does not occur, the replacement of a smooth surface with a surface which is interrupted in the peripheral direction does not have any effect at all. The raised surface sections can even form a structuring which approximately equals the skin of an orange. The thread can easily slide thereon without getting hooked.

The Swedish patent application No. 345 293 as published May 23, 1972, does disclose providing an intermittent feed of threads with different adhesive tendency to a knitting machine, each thread of which is looped around a friction roller at least one time for 360°. Depending on the adhesive tendency of the thread, a friction roller which differs in diameter and/or surface structure is utilized. For particularly adhesive-happy threads, the surface is roughed up by sand blasting in order to produce a larger friction coefficient for the thread. In this manner the slip can be adjusted so that, in a peripheral direction, the actually different threads are delivered with the same speed or thread tension. The principle is hereby to provide a thread which actually slides easily with an adhesive tendency caused by its material structure, and a rough rotating roller surface with which both its sliding friendliness is suppressed through an increased friction and also its inherent adhesive tendency is overcome by the increased friction. The condition is thereby, however, that in the peripheral direction of the friction roller there exists a relative movement between the thread and the roller. This principle is therefore without importance for a device of the abovementioned type, in which relative movements in the peripheral direction do not take place between the thread windings and the drum jacket. Rather, a roughing up of the drum jacket through sand blasting would produce pointed surface peaks, which cause a hooking of the thread windings and make the advancing movement, occurring in the longitudinal direction of the drum, impossible.

In a preferred embodiment of this invention, the drum has elevated surface sections which extend in the axial direction. Here too it is observed that the movement of the thread windings and the withdrawal takes place surprisingly easily.

A further advantageous exemplary embodiment of this invention, as applied to a storage drum of rods which are arranged cagelike around the drum axis and are approximately parallel to one another, provides the rods with surface profiles, like serrations, which extend longitudinally of the rods. A substantially reduced contact surface is offered aligned in the longitudinal direction of the drum to the on-lying thread windings, so that the adhesive tendency of the thread can now lead to insignificant resistive forces in relationship to the advancing movement and the withdrawal of the thread.

The material selection in connection with the reduced contact surface reduces the adhesion of the thread windings still further. Furhermore in the case of rods which are extruded from aluminum the longitudinal grooves can be formed very well. The rods can be manufactured inexpensively and with constant dimensions.

Further, advantageous embodiments of the subject matter of the application are disclosed in the following, including in particular a method for causing a hard-eloxation which has extremely desired roughness or gripping capacity, and which in addition is very durable.

Embodiments of the subject matter of the invention will be discussed in more detail hereinafter.

DETAILED DESCRIPTION

Figure 1:
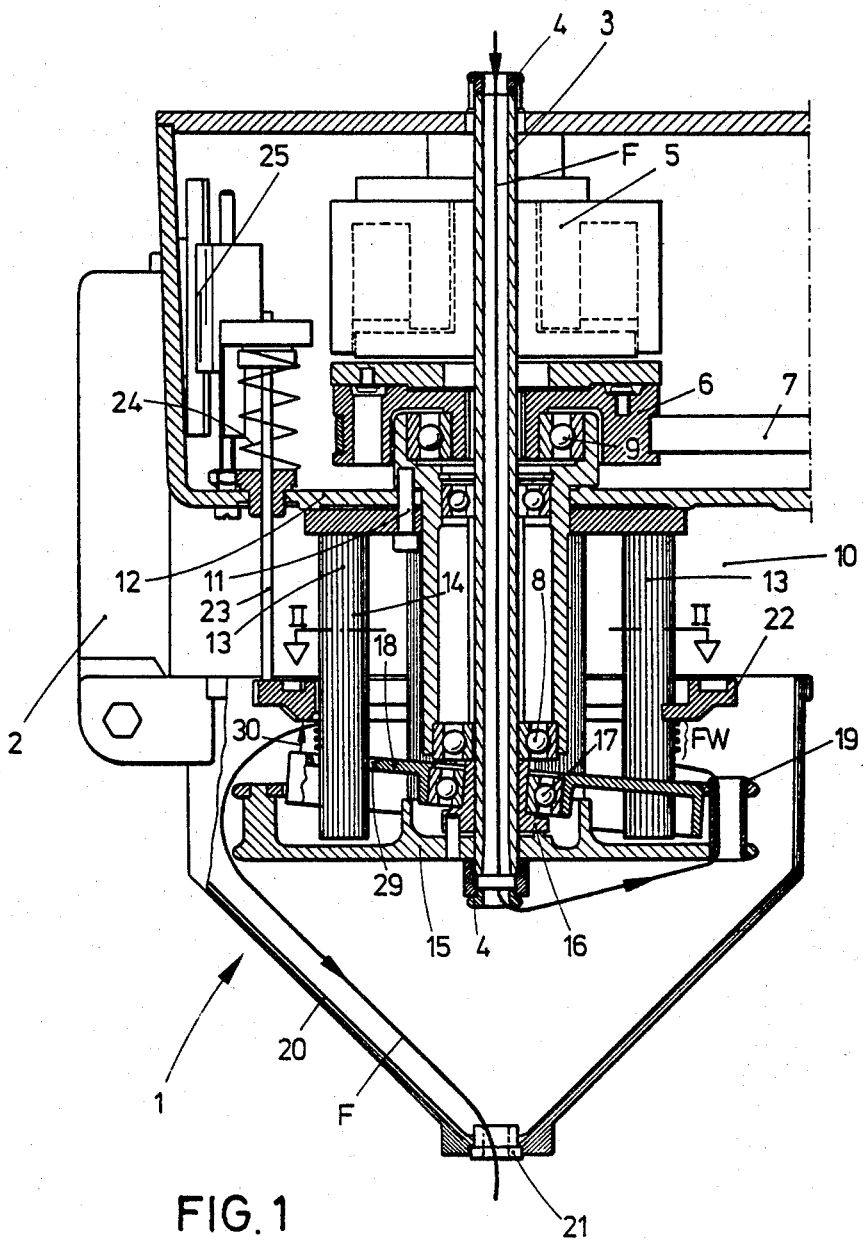
FIG. 1 is a cross-sectional view of a thread-storage and delivery device.
Figure 2:
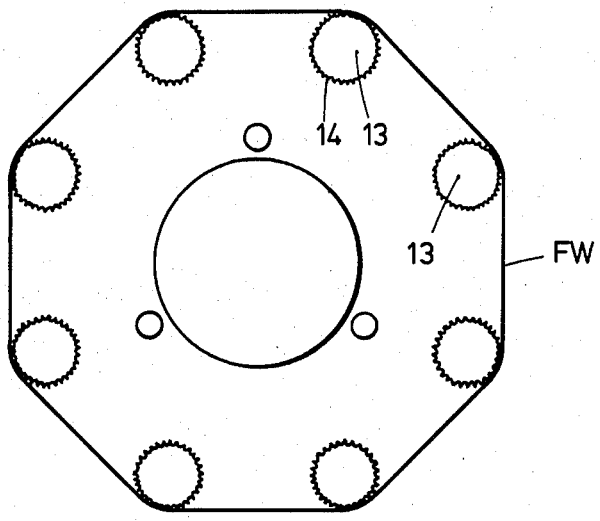
FIG. 2 is a cross-sectional view of the storage drum of the device according to FIG. 1 in a plane II-II.

A thread-storage and delivery device 1 for a textile machine has a stationary base member 2, on which is arranged also the motor (not illustrated) with its control members. A hollow shaft 3, which extends all the way through the device and has ceramic thread eyelets 4 on both ends, can be rotatably driven by an electric coupling 5 through a belt pulley 6 and a driving belt 7. The shaft is supported in the base member 2 by roller bearings 8. The belt pulley 6 runs on a roller bearing 9 which is also held in the base member 2. A storage drum 10 is connected nonrotatably to the base member 2 through fastening elements 11 and an intermediate plate 12. Said storage drum consists substantially of rods 13 which are grouped cagelike around the longitudinal center axis of the device (FIG. 2). The rods are cylindrical and have grooves 14 oriented in the longitudinal direction.

A disk member 15 is connected nonrotatably to the shaft 3, on which disk member is supported nonrotatably a sleeve 16 which grips around the shaft 3 and which carries a bearing surface for a further roller bearing 17, which bearing is inclined with respect to the shaft axis. The bearing 17 holds a disk-shaped thread advancing member 18, which is provided with openings 29 for the rods 13, so that it is prevented from rotating with the disk member 15. A thread-feeding member 19 is held in the disk member 15 near its outer periphery.

A conically shaped hood 20 is united with the base member 2, which hood contains in the apex of the cone a stationary thread eyelet 21. The drum jacket formed by the rods 13 is surrounded by a feeler ring 22, which is resiliently movable in the longitudinal direction of the drum through a connecting rod 23 and a spring 24. This ring 22, through rod 23, cooperates with a contact mechanism 25 which is electrically connected to the electric coupling 5. The ring 22 has conical fingers which grip under the front thread windings and spreads same open for easier removal.

OPERATION

The thread F which comes from the thread spool is fed through the shaft 3 and is then threaded through the feed member 19 at the other end. Subsequently the thread encloses the drum jacket with a plurality of thread windings FW as a thread storage, until the thread rests on the feeler ring 22. From there the thread is then again unwound in an outwardly guided arc around the outer edge of the disk member 15 through the stationary thread eyelet 21. The feeler ring 22 feels the thread windings FW at their upper extent on the drum jacket and, depending on the adjustment of its spring 24, emits a signal through the contact mechanism 25, based on which signal said electric coupling 5 rotates the shaft 3 and the feed member 19, so that if needed new thread windings can be wound up. By rotating the shaft 3, the advancing member 18 which is coupled with the rods 13 starts a wobbling movement, which through its outer section which projects over the drum jacket produces in the direction of arrow 30 an axial advancing movement for the thread windings FW.

Through this wobbling movement, the thread windings which are applied by the feeding member 19 are constantly moved in a direction toward the feeler ring 22.

FIG. 2 shows the arrangement of the rods 13 for the formation of the drum jacket. The thread windings grip around the peripheral parts of the rods 13 in a polygon-like manner, which rods 13 have the longitudinal grooves 14 formed therein. The grooves in the rod surface, which grooves are provided in the longitudinal direction of the rod, reduce the size of the entire contact surface between the thread windings FW and the drum jacket, so that the adhesion of the thread, in particular if we deal with a "sticky-yarn", remains negligibly low. The total adhesion of the thread windings on the drum jacket is determined by the size of the common contact surface and is naturally substantially smaller if the contact surface is formed only by individual small surfaces on each rod 13, and not by a larger continuous smooth surface on each rod, as common up to now.

Figure 3:
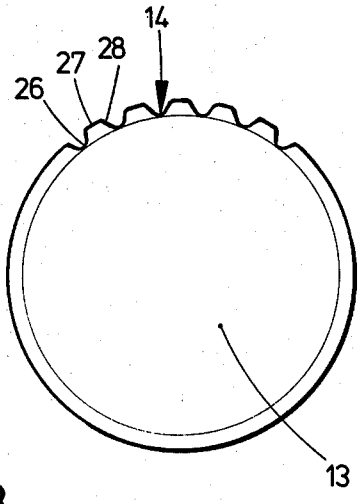
FIG. 3 is an enlarged detail of FIG. 2.

FIG. 3 illustrates the cross section of a rod 13 and the construction of the grooves 14. The grooves 14 are rounded notches 26 which are arranged in the longitudinal direction, and between which exist narrow intermediate surface sections or ribs 27 which are rounded in the area of their longitudinal edges 28. Each rod can for example consist of aluminum which was extruded. During extrusion the aluminum is pressed at a temperature below its melting point through a matrix which determines the cross-sectional shape of the extrusion. Of course other mechanical methods of operation are possible to achieve the grooves in the surface of the rod 13.

In order that the drum surface which is determined by the grooves remains suitably wear-resistant, eloxation is used to provide a hard surface layer which has a desired permanent roughness.

The rod 13 which is illustrated in FIG. 3 has an outside diameter of 11.8 mm., the grooves have a depth of 0.5 mm. with a width of approximately 0.7 mm. The width of the intermediate surface sections 27, which lie between the grooves 26, is approximately 0.7 mm. The longitudinal edges 28 are rounded off with a radius of 0.2 mm. The flank areas which follow the surface sections 27 are advantageously inclined at 15° with respect to the base of the groove.

The basic advantage which is achieved with the subject matter of this invention lies in the axial advance of individual thread windings of the thread storage being substantially easier, and a practically one-layer thread storage is achievable therewith. Due to the reduced adhesion between the thread windings and the drum jacket, the thread withdrawal from the drum is also substantially easier, namely the thread-withdrawing tension becomes desirably low.

We claim:

1. A thread-storage and delivery device for a textile machine, which device includes a storage drum on which a thread is wound tangentially to form a thread storage which consists of a plurality of thread windings wrapped around the drum and from which the thread is withdrawn for supply to the textile machine, the thread drum being of a cagelike structure and formed from a plurality of elongated cylindrical rods which are angularly spaced from one another in a substantially cylindrical pattern about the longitudinal axis of the drum, said plurality of rods defining an outer peripheral surface for said drum on which the thread windings are engaged, the rods being angularly spaced apart so as to define longitudinal peripheral slots therebetween, and a thread-advancing device having portions thereof projecting radially outwardly through said slots for engaging the thread windings to cause the latter to slide axially along said peripheral surface as defined by said rods, comprising the improvement wherein each rod on at least that portion of its exterior surface which defines a part of the drum peripheral surface is provided with a plurality of parallel narrow grooves formed therein and extending axially thereof, which said narrow grooves are separated by narrow axially-extending ribs, the outer free edge of each said rib defining a narrow axially-elongated surface section which defines a part of the peripheral drum surface and is engaged by the thread windings, said surface section having a width in the circumferential direction of the drum of at least approximately 0.7 mm, and said groove having a width in said circumferential direction which does not significantly exceed the width of said surface section.

2. A device according to claim 1, wherein said rods are provided with said axially-extending grooves and ribs around the complete periphery thereof, and wherein the longitudinal limiting edges of the narrow surface section are rounded.

* * * * *